US005781645A

United States Patent [19]

Beale

[11] Patent Number: 5,781,645

[45] Date of Patent: Jul. 14, 1998

[54] LOUDSPEAKER SYSTEM

[75] Inventor: Christopher John Beale, Tamworth, England

[73] Assignee: SSE Hire Limited, England

[21] Appl. No.: 623,197

[22] Filed: Mar. 28, 1996

[30] Foreign Application Priority Data

Mar. 28, 1995 [GB] United Kingdom ..... 9506263

[51] Int. Cl.[6] ..... H04R 25/00

[52] U.S. Cl. ..... 381/182; 381/24

[58] Field of Search ..... 381/24, 182, 186, 381/188, 205, 88, 89, 90; 181/144, 145, 147, 199

[56] References Cited

U.S. PATENT DOCUMENTS

| | | | |
|---|---|---|---|
| 4,057,689 | 11/1977 | Smith | 181/145 |
| 4,107,461 | 8/1978 | Bose . | |
| 4,227,047 | 10/1980 | Horne . | |
| 4,961,226 | 10/1990 | Bose | 381/24 |
| 5,199,075 | 3/1993 | Fosgate | 381/24 |
| 5,260,920 | 11/1993 | Yamaha | 381/63 |
| 5,590,214 | 12/1996 | Nakamura | 381/182 |

FOREIGN PATENT DOCUMENTS

| | | | |
|---|---|---|---|
| 3130301 | 2/1983 | Germany | 381/24 |
| 0998884 | 7/1965 | United Kingdom . | |
| 2240689 | 8/1991 | United Kingdom . | |

*Primary Examiner*—Huyen Le

*Attorney, Agent, or Firm*—Andrus, Sceales, Starke & Sawall

[57] ABSTRACT

A loudspeaker system comprises an array of cells each including a loudspeaker driver unit. The axes of all the driver units converge at a single point in front of the array, such point normally lying between the array and the listeners. An arrangement is described for steering the sound from the system by varying the relative level of the audio frequency signals applied to the driver units.

3 Claims, 2 Drawing Sheets

LOUDSPEAKER SYSTEM

BACKGROUND OF THE INVENTION

1. Field Of The Invention

This invention relates to a loudspeaker system of the kind known as an acoustic array and comprising a plurality of cells or elements each of which in use propagates acoustic energy.

2. Description of the Prior Art

In the use of the acoustic array it is positioned to direct acoustic energy towards an audience. Each cell of the array may be of the same type for example a loudspeaker of a particular diameter, or more than one loudspeaker of differing diameter or diameters, mounted concentrically within each cell or the array may comprise several series of cells each cell of a series being identical with the other or others in the series but with the cells in the different series being chosen to deal with a particular range of frequencies.

SUMMARY OF THE INVENTION

The conventional practice in constructing a multiple loudspeaker array is to mount the loudspeaker cells in convex fashion so that the axes of the cells meet at a point which is behind the array i.e. opposite to the direction of propagation of sound from the array. With such an arrangement so called comb filtering takes place due to wave interference between the loudspeakers forming the array, and it is well known that the sound intensity and quality varies along the plane normal to the general axis of the array. The practical effect is that at some positions in front of the array the sound reproduction may be poor whilst at other positions the reproduction may be entirely satisfactory.

The object of the present invention is to provide an acoustic array of the kind specified in an improved form.

According to the invention in an acoustic array of the kind specified the cells are arranged with their axes converging towards the listener.

According to a further feature of the invention in an acoustic array of the kind specified each cell is positioned so that its axis passes through a common point which is positioned between the array and a listener.

According to a still further feature of the invention each cell of a series of identical cells in the array is positioned at the same distance from said point measured along the axis of the cell.

DESCRIPTION OF THE PREFERRED EMBODIMENTS

Figure 1:
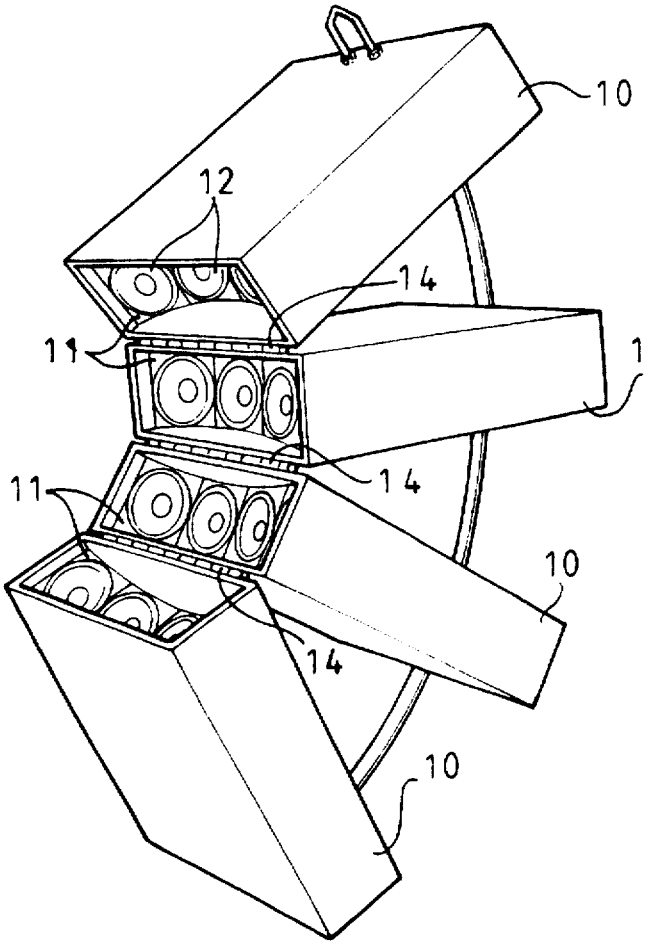
FIG. 1 is a perspective view showing one example of a loudspeaker system in accordance with the invention.
Figure 3:
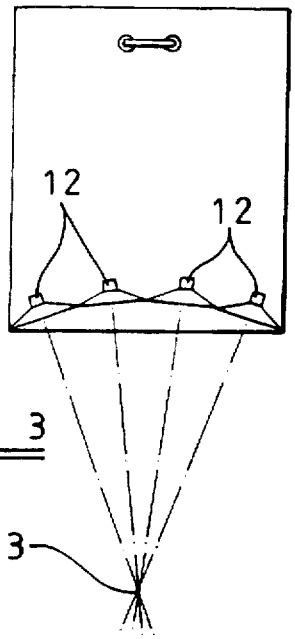
FIG. 3 is a view of one multi-cell unit forming the system of FIGS. 1 and 2.
Figure 2:
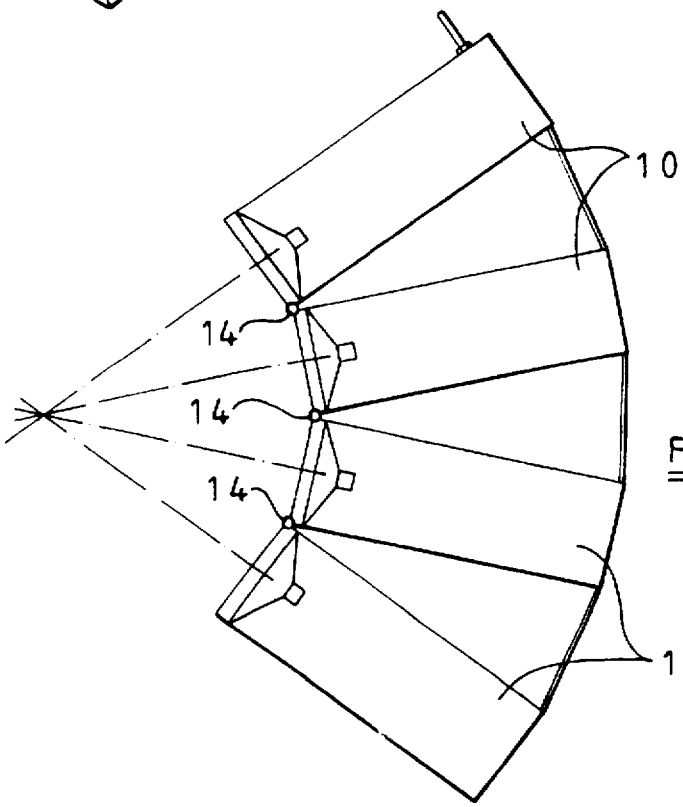
FIG. 2 is a side view of the loudspeaker system.
Figure 4:
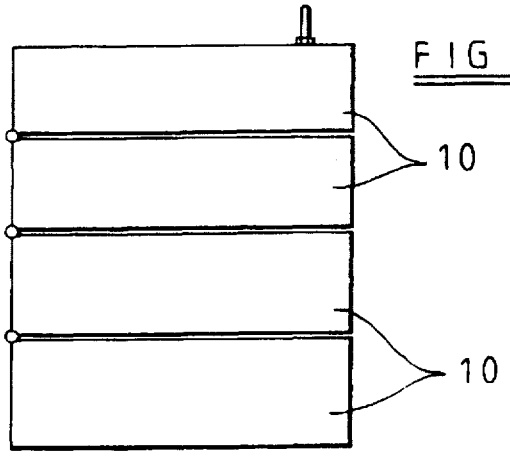
FIG. 4 is a side view of the system showing the units stacked for transportation.

In the example shown in the drawings, an array of cells is made up of four multi-cell units 10. Each unit 10 is in the form of cuboidal box with a segmental baffle 11 set back from one end. The baffle 11 has four segments and a loudspeaker driver unit 12 is mounted on each segment. As shown in FIG. 3 the axes of the driver units 12 converge to a single point 13 in front of the unit. These axes lie in a single plane.

The four units 10 are connected together by hinges 14 along their front edges and are splayed apart at the back. The angle of splay is such that the planes of the axes of the driver units 12 in each unit 10 meet in a single line on which the point 13 lies. All the driver units are equidistant from the point 13.

It will be appreciated that from the viewpoint of the listener the array will have a concave appearance as opposed to the known arrangement which has a convex appearance. So far as the acoustic performance is concerned the output of the array will appear to the listener to come from a single source at said point. Moreover, it can be demonstrated that the comb filtering effect is substantially eliminated.

With the cells arranged as described the front edges of the cabinets are much closer together than with the known construction and this leads to a more compact arrangement and in addition, raises the frequency at which mutual interference between cells takes place.

In a practical arrangement each loudspeaker cell may have one or more loudspeaker driver units of differing diameters to deal with different frequency ranges. These loudspeakers driver units may be mounted concentrically within the cell or may be mounted in close proximity to each other. Each loudspeaker driver unit or closed group of loudspeaker driver units can be regarded as a cell and should be positioned in the cabinet so that its axis passes through said point. Alternatively each loudspeaker driver unit can be housed in its own cabinet with the differing loudspeaker driver units distributed as evenly as possible throughout the array. As stated the driver units should be the same distance from the point 13. If for some reason this is not physically possible time delays can be introduced so that from the acoustic point of view the driver units are equidistant.

In the application of the invention one or more arrays may be positioned in such a way that the combined outputs of the arrays is sufficient to address the required audience area.

Figure 5:
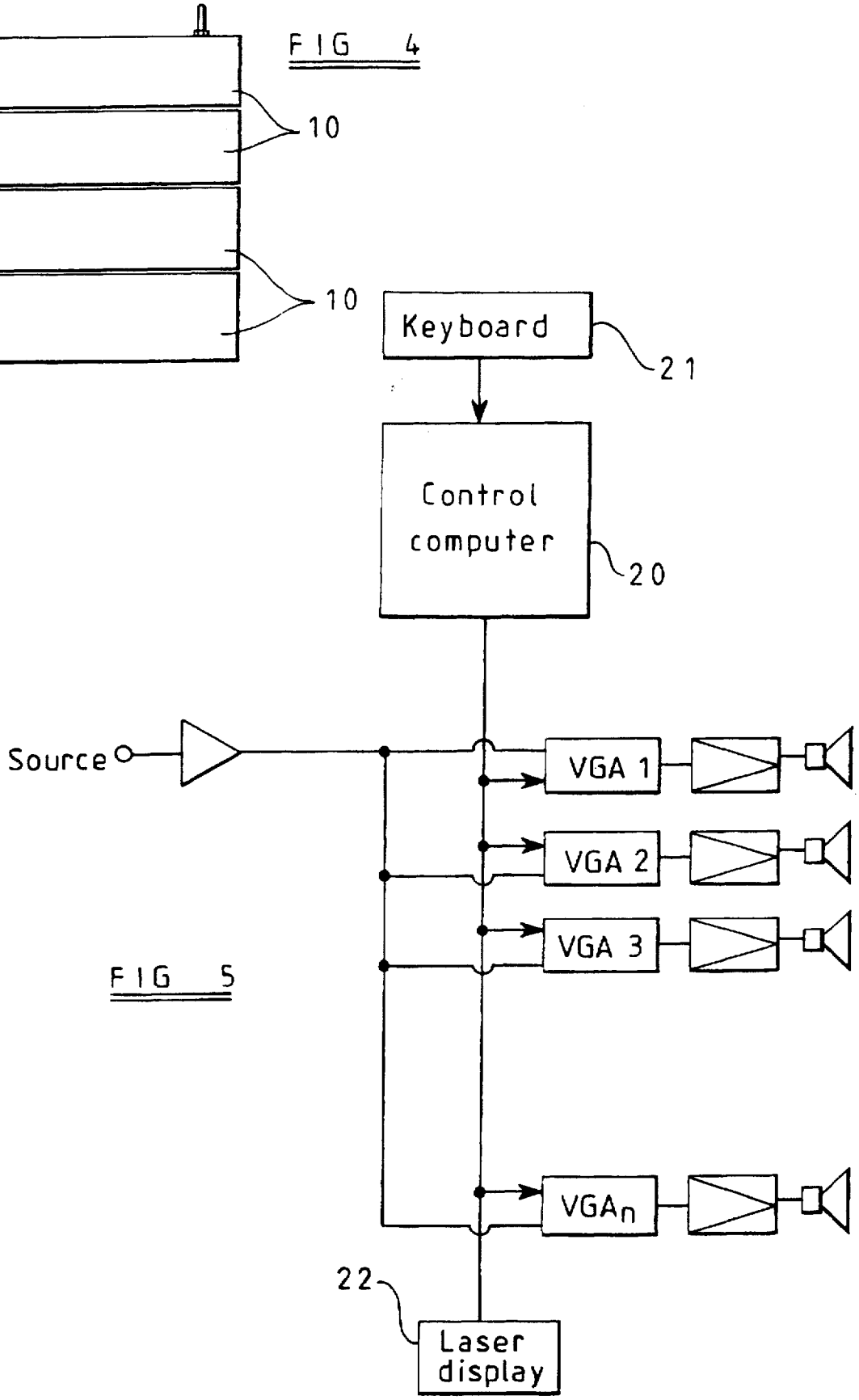
FIG. 5 is an electrical block diagram showing an arrangement for driving the loudspeaker system.

When installed in a concert hall the usual practice is to have two arrays at opposite ends of the stage although not necessarily at stage level. With such an arrangement it is desirable to be able to modify the shape of the wave front so that the acoustic power is directed at the desired target and not for example at the ceiling and walls which is wasteful of power and may result in unwanted reflections. If each cell is provided with its own amplifier which may be mounted in the cell cabinet or at some remote point, it is possible to adjust the amplitudes of the amplifier outputs, their phase or frequency shift, to modify the shape of the wave front produced by the array. In order to assist the adjustments required, a scanning laser beam may be located in the array construction and moved to describe the pattern of the acoustic output. Adjustments can then be effected manually or by microprocessor, to the amplifiers so that the required acoustic pattern is produced by the array. FIG. 5 shows one example of such an arrangement. A control computer 20, which receives input from a keyboard 21 or other control device, provides digital control outputs to a series of variable gain amplifiers VGA1, VGA2 . . . VGAn which determine the amplitude of the respective signals supplied from a common source to power amplifiers respectively associated with the loudspeaker driver units. The computer also controls the laser display unit 22. In the default condition all the variable gain amplifiers have their gains set to the same value and the laser display unit 21 is caused to sweep its beam around a right circular cone. Where, as is usual, the loudspeaker system is mounted high up and directed downwardly at about (say) 45° to the horizontal, the laser beam will trace an ellipse on the floor or ground. When the relative levels of signals to the power amplifiers are varied the output to the laser display is correspondingly varied to change the shape and position of the figure traced on the floor. In this way the operator can set up the system to obtain the desired sound pressure level distribution.

There may be a second VGA associated with each power amplifier which controls the level of the signal from a second source. The computer can be used to set up a different sound pressure distribution for the second source.

It is also possible using the mechanical adjustment to arrange for the array to be asymmetric i.e. for the axes of the cells to converge at a different point in the vertical to that in the horizontal. This may be required if the desired area of coverage is outside the scope of the variation possible using the electrical methods mentioned above. In this case there may be an increase in mutual interference at high frequencies, the frequency diminishing as the degree of asymmetry increases.

I claim:

1. A loudspeaker system for providing uniform sound field in a listening area comprising a concave array of identical cells, each having at least one loudspeaker driver unit arranged to direct acoustic energy along an axis of the driver unit of the cell, the driver units being arranged with their axes converging in the direction of propagation of the acoustic energy, each of their axes of the cells converging and intersecting at a common point between the array and a listening area, and the cells lying equidistant from the common point, the array being constructed and arranged to reduce interference between the driver units in a field inside the listening area, and provide information from the array as if it were emanating from a single cell;

wherein the array is formed of a plurality of multi-cell units, the cells of each unit being rigidly connected together with the axes of such cells in a common plane, the multi-cell units being connected together with the common planes of the respective units inclined to one another.

2. A loudspeaker system as claimed in claim 1, in which the multi-cell units are hingedly connected together along adjacent front edges thereof so that the array can be formed into a stack for transportation and opened out into an operative configuration for use.

3. A loudspeaker system as claimed in claim 1, further comprising a plurality of power amplifiers connected to respective ones of the loudspeaker driver units and means for adjusting the relative amplitudes of audio-frequency signals which are applied to respective ones of the power amplifiers from a common source, so as to modify the shape of wavefronts generated by the array in use.

* * * * *